United States Patent [19]

Welsby et al.

[11] 4,326,121

[45] Apr. 20, 1982

[54] ELECTRIC IMMERSION HEATER FOR HEATING CORROSIVE LIQUIDS

[75] Inventors: Dennis H. Welsby, Donning; Alan G. Dewson, Workingham, both of England

[73] Assignee: E. Braude (London) Limited, Surrey, England

[21] Appl. No.: 20,721

[22] Filed: Mar. 15, 1979

[30] Foreign Application Priority Data

| | | | |
|---|---|---|---|
| Mar. 16, 1978 | [GB] | United Kingdom | 10548/78 |
| May 4, 1978 | [GB] | United Kingdom | 17849/78 |
| Dec. 12, 1978 | [GB] | United Kingdom | 48188/78 |

[51] Int. Cl.[3] ..... H05B 3/80; F24H 1/22; H01C 3/18

[52] U.S. Cl. ..... 219/523; 219/319; 219/322; 219/335; 219/338; 219/532; 219/552; 338/254; 338/301; 338/321

[58] Field of Search ..... 219/322, 316, 319, 335–338, 219/523, 375, 376, 551, 532; 338/301, 254–256, 296, 282, 321

[56] References Cited

U.S. PATENT DOCUMENTS

| | | | |
|---|---|---|---|
| 566,341 | 8/1896 | Rockwell | 338/321 |
| 918,732 | 4/1909 | Chase | 219/523 |
| 1;151,403 | 8/1915 | Ryce et al. | 219/523 |
| 1,540,964 | 6/1925 | Trahan | 219/523 |
| 1,661,062 | 2/1928 | Ambory | 219/523 |
| 1,695,753 | 12/1928 | Baker | 219/523 |
| 2,614,200 | 10/1952 | McNair | 219/523 X |

FOREIGN PATENT DOCUMENTS

| | | | |
|---|---|---|---|
| 2155564 | 2/1973 | Fed. Rep. of Germany | 219/523 |
| 869118 | 10/1941 | France | 338/301 |
| 227554 | 9/1943 | Switzerland | 219/523 |

*Primary Examiner*—A. Bartis

*Attorney, Agent, or Firm*—Emory L. Groff, Jr.

[57] ABSTRACT

An electric immersion heater of planar construction for use in industrial processes is constructed of a non-corrodable material and may be immersed at the side of a processing not containing corrosive liquids. The heater includes a thin planar polymeric support frame having side members with end sections extending beyond the end portions of the frame. An electrical resistance heating element wire shrouded with an integral layer of polymeric material is wound around the end portions of the frame to form a substantially flat heating element assembly. Imperforate polymeric cover plates are secured in spaced relationship to opposite faces of the heating element assembly by spacing and securing means engaging the side members of the frame. The peripheral edges of the cover plates are spaced apart to form a gap allowing for free flow of fluid through the heater between the plates throughout the entire extent of the heater.

5 Claims, 6 Drawing Figures

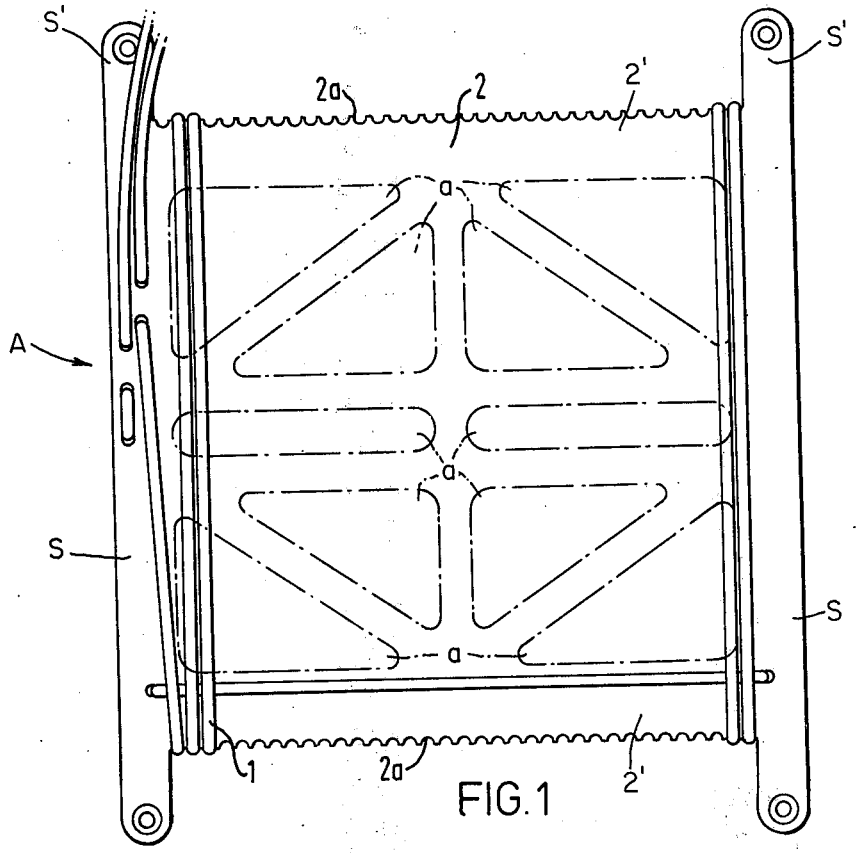
FIG. 1
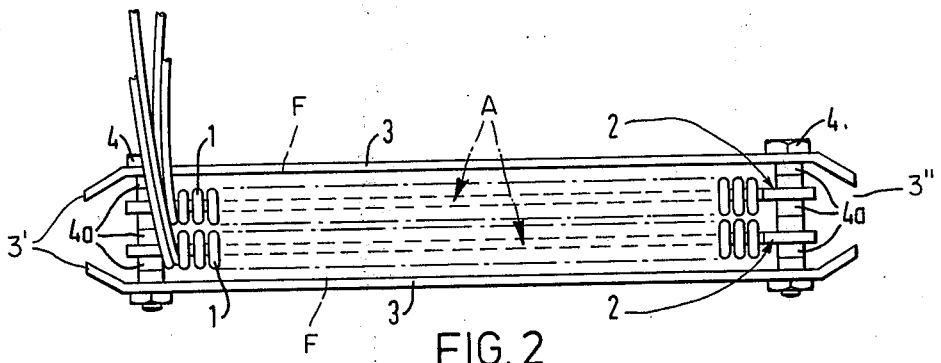
FIG. 2
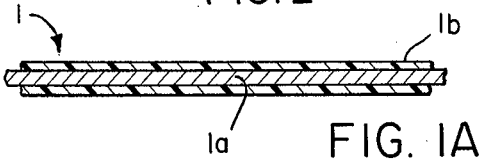
FIG. IA

ELECTRIC IMMERSION HEATER FOR HEATING CORROSIVE LIQUIDS

BACKGROUND OF THE INVENTION

This invention relates to an electric immersion heater in which an insulated resistive heating element is immersed in the liquid directly, the element being suitably supported and shrouded for protection.

A construction of heater of the aforementioned kind is disclosed in British Patent No. 1,360,334 wherein a resistance wire coated in PTFE is wound around a tubular support element provided with apertures through which liquid may flow. An outer protective housing being provided which is apertured also to allow liquid flow. With a single heater wire element a relatively long length is necessary to achieve a suitable value of resistance with good heat dissipation. This creates difficulties in accommodating the wire length in a manner which affords good heat dissipation into the liquid, and in which minimum contact with the support is made.

An object of this invention is to provide an immersion heater unit in which a heating wire is disposed in a manner affording good liquid flow thereover due to convection and in which the maximum amount of wire surface area is fully in contact with the liquid to be heated.

SUMMARY OF THE INVENTION

According to this invention there is provided an electric immersion heater comprising a planar support frame on which an electrical resistance heating element wire is disposed, the wire comprising a single length of resistance wire with conductive connections at each end and shrouded with an integral layer of an electrically insulating heat resistive material, the wire length being wound around two opposed end portions of the frame to form a substantially flat assembly, the assembly having at least one covering plate spaced from and planar with the assembly.

Preferably the covering plates are provided over both side surfaces or faces of the assembly. The frame may include a lead out device along an edge to which the ends of the element wire are brought for connection with an electrical supply lead. A support means for the lead out device may be provided on the edge of the assembly.

Two or more assemblies of the support frame and wire may be provided between the covering plates.

The advantages of a the construction of heater according to the invention reside in the flat shape affording positioning at a side of a tank of liquid and the relatively large area presented by the wound element thus giving good heat exchange. The covering plates also assist in maintaining a channel for convection flow upward through the support frame, the flow being unimpeded. With one covering plate the heater may be located closely adjacent the wall of a tank which then effectively forms the other plate to establish convection. The frame will preferably be constructed with an open or closed central region and may comprise simply a rectangular frame or ribbed flat sheet to keep the portions in contact with the element as small as possible. The covering plates and frame may be of a temperature resistant plastics material as they do not take part in the heat dissipation and only small portions are in contact with the element. Preferably non-corrodable polymers are used in the construction and the immersion heater may then be used in process tanks with corrosive liquids which normally would require special resistant metals to be used for the construction.

To provide for safeguard against electrical leakage due to faulty insulation a bare wire of platinum or other noble metal or the other material as appropriate to the liquid is threaded through the frame for convenience and connected with a leakage sensing device. In practice such a system provides a better indication of a potentially dangerous fault than by using an earthed sheath.

Fluorinated ethylene propylene or PFA is preferred for the coating on the heating wire although the specific choice is dependent on the medium to be heated. The use of a polymer ensures a long service life and prevents inducement of stray electric currents as normally experienced with metal encased immersion heaters.

The support frame may be a non-corrodable polymer such as polytetrafluoroethylene (PTFE) or poly-vinylidene-fluoride or a heat and corrosion resistant substance of similar properties.

The frame assembly may be constructed in such a manner as to permit free circulation of liquid through the heating element with perforated or louvred form to ensure the most efficient liquid flow over the heating elements and further providing minimal contact between the heating element and frame core.

When the frame core is square or rectangular it may readily be fitted behind the anode baskets in electroplating tanks. Due to the compact nature and high energy output, it can usually be placed in the most thermally efficient part of the tank or vessel which is near the base.

The heating element wire of copper-nickel for example may be connected internally to a wire of the same nominal diameter but of a lower resistance which permits the ends of the element to be taken out of the liquid. Electric current is fed through the low resistance terminal wires to the heating element. The terminal wires may be joined or welded as a unit to the main resistance wire and will preferably be also encapsulated within the shroud or sheathing.

To provide suitable remote electrical connections the low resistance portion of the element wire may be passed through a flexible, impervious and non-corrodable tube or similar conduit to a synthetic resin potted connector from which a conventional electrical cable emerges. The flexible tube or conduit may be secured to the frame at one end by clamp means.

BRIEF DESCRIPTION OF DRAWINGS

By way of example only, reference is made to the accompanying drawings illustrating two embodiments and in which:

FIG. 1 is a side elevation of the assembly of a heating element secured to a rectangular planar support frame, FIG. 1A is a longitudinal sectional view through the heating element wire, FIG. 2 is a top plan view of two heating element assemblies secured between covering plates and forming an immersion heater.

DESCRIPTION OF PREFERRED EMBODIMENTS

Figure 3:
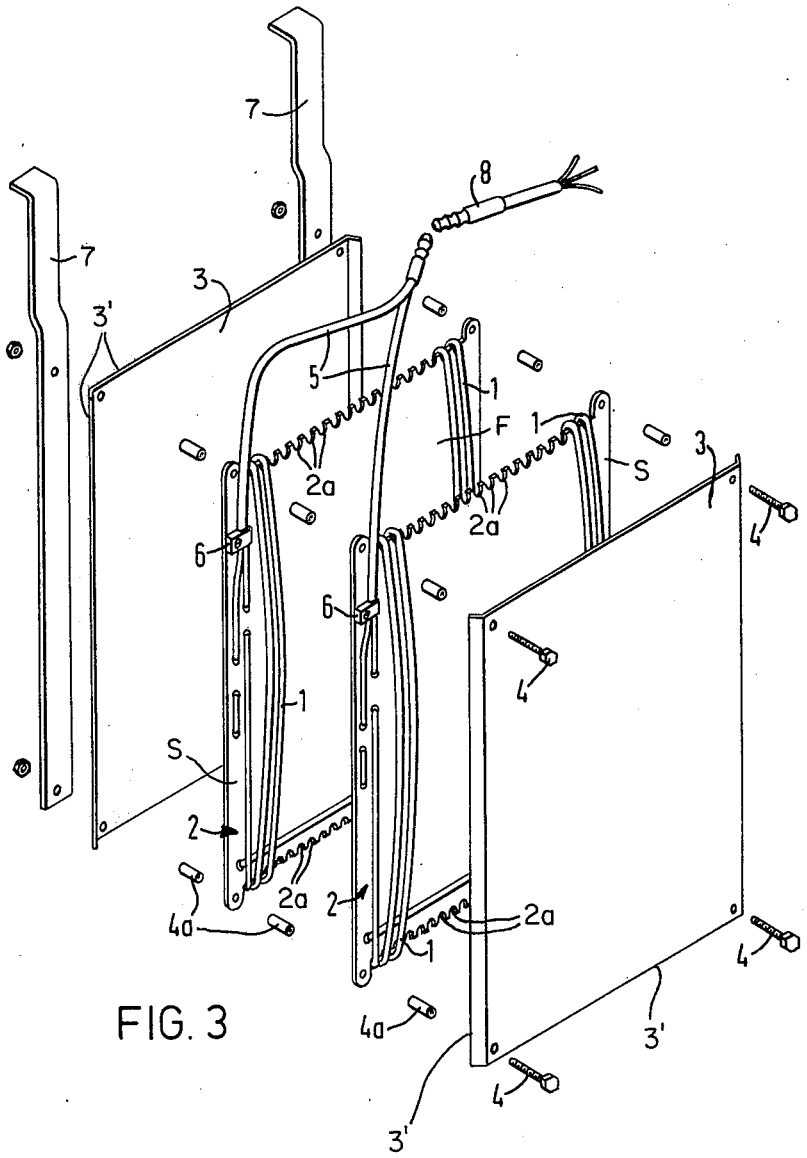
FIG. 3 shows an exploded perspective view of the immersion heater shown in FIG. 2.

In FIGS. 1 to 3 of the drawings an electrical resistance heating element has a resistive wire 1A sheathed in or shrouded by a fluorinated polymer 16 such as fluorinated ethylene propylene applied by means of an extrusion process and wound around two opposed end portions 2' of a support frame 2 including side members S having end sections S' extending beyond the end portions 2'.

Two such assemblies A of wire and frame are shown. The assemblies A are secured in spaced relationship using bolts 4 with spacers 4*a* and in addition coextensive imperforate covering plates 3 are secured also with said bolts and spaced from respective face F of the assemblies A. A frame/wire assembly A is shown more clearly in FIG. 1 and has cut-away portions a, affording better liquid penetration of the heating wire surface and less interference with heat dissipation, and grooves 2*a* in which the wire 1 lies in passage around the frame end portions 2'. The two ends of the heating element are each brought out through a shroud tube 5 secured to the frame by a clamp 6. An electrical connector 8 is provided for connection with a supply of electrical power. The construction further includes mounting brackets 7 by which the heater may be suspended in a tank of liquid.

The construction as shown provides accommodation for a considerable length of heating wire of which substantially the whole surface is in contact with the liquid. The pair of coextensive, imperforate covering plates 3 include peripheral edges 3' which will be seen from FIG. 3 to be mounted, by means of the bolts 4 and spacers 4*a*, to provide a peripheral gap 3" therebetween. The covering plates 3 serve to establish a convection flow upwards over the heating element and, further, protect the actual element from damage.

Figure 4:
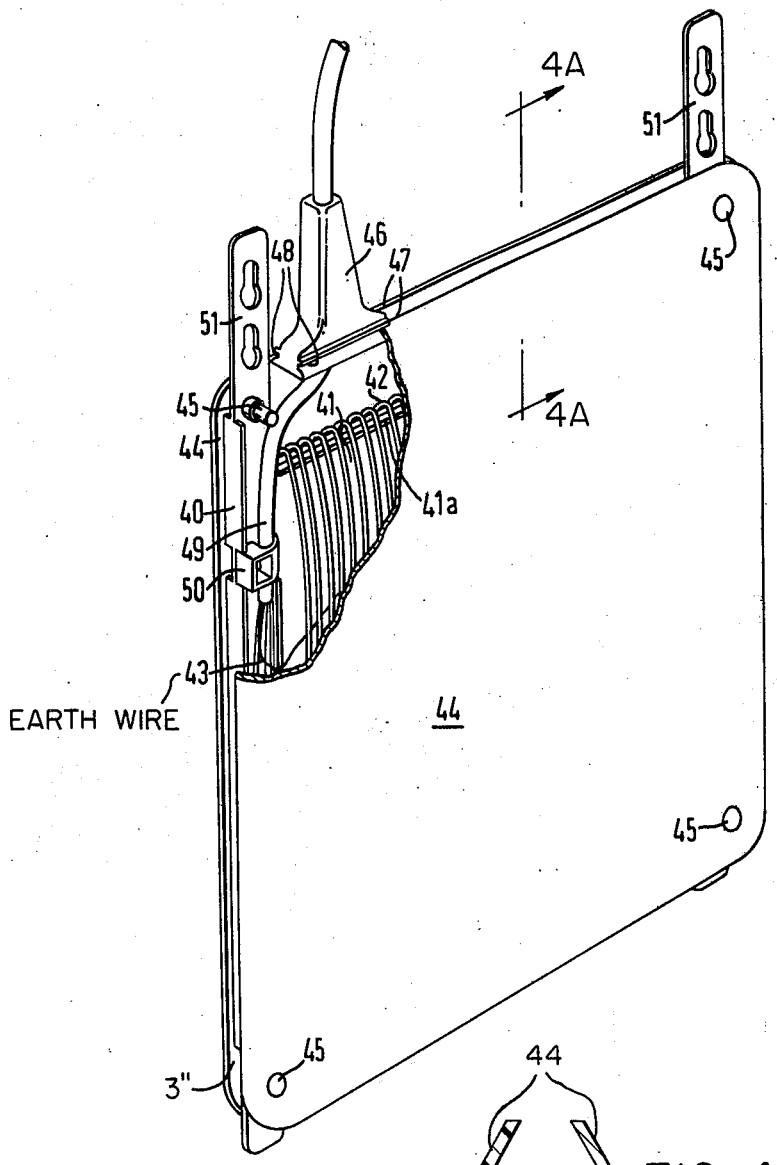
FIG. 4 is a perspective view of an immersion heater part cut-away with modification.
Figure 4A:
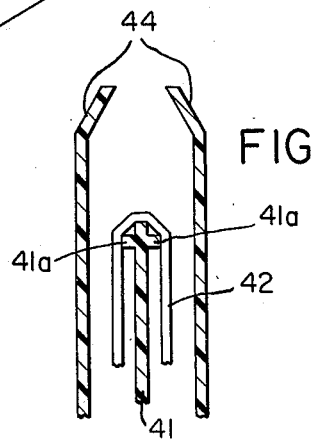
FIG. 4A is a vertical sectional view taken along the line 4A—4A of FIG. 4.

FIG. 4 shows another preferred construction of immersion heater having a flat support structure 41 forming a frame with opposed end portions around which the heating element 42 is taken comprising longitudinal rib 41*a* on each end and arranged so that the element 42 has only three points of contact with the frame structure in passing around the edge. An earth wire 43 of platinum or other conductor as appropriate to the application is provided within the frame and may be used as a leakage sensing wire. To each side of the support frame a covering plate 44 is secured by means of rivets 45 and a cable support 46 may be retained by inwardly directed lips or peripheral edges 47 of the plates engaging respective grooves 48 in the block. The electrical connections from the heating element are brought up through a lead out tube 49 secured to the frame by a clamp 50.

The support frame 41 has side members which are extended upward as shown to form hanging lugs 51. The constuction again provides a convection flow up through the heater assembly in view of the peripheral gap 3 and the whole construction may be of a heat resistant non-corrodable polymer. The support frame may comprise simply a rectangular frame of the side members and rib end portions or may include bracing in filling the central area to give structural rigidity as necessary. The heating wire element may be of the previously described construction.

We claim:

1. An electric immersion heater comprising, a support frame having opposed end portions and side members, said support frame defining a thin planar substantially rectangular frame, said side members provided with end sections extending beyond said frame end portions, an electrical resistance heating element wire wound around said frame opposed end portions to form a substantially flat wound assembly having opposite faces, said wire having conductive connections at each end and shrouded with an integral layer of an electrically insulating, heat resistive material, an imperforate covering plate having peripheral edges and coextensive with and juxtaposed each said assembly face, and spacing and securing means engaging said side members and attaching said covering plates in a spaced manner relative said assembly faces with said peripheral edges of said two covering plates likewise spaced apart whereby, a gap is formed between said two plate peripheral edges allowing for free flow of fluid through said heater between said spaced apart covering plates throughout the entire extent of the gap between said spaced apart covering plates.

2. An electric immersion heater as claimed in claim 1 wherein, ends of said wound element wire are attached to one said support frame side member and said wire ends are disposed within a shroud tube.

3. An electric immersion heater as claimed in claim 1 including, a plurality of said assemblies secured together in spaced relationship between said two covering plates by said spacing and securing means disposed at said end sections of said side members.

4. An electric immersion heater as claimed in claim 1, wherein said frame and covering plates are of a non-corrodable heat resisting polymer.

5. An electric immersion heater as claimed in claim 1 wherein, said spacing and securing means includes bolts extending through said plates and side members and having spacers thereon to provide said gap between said plate peripheral edges.

* * * * *